US008474667B2

(12) United States Patent
Schwartz

(10) Patent No.: US 8,474,667 B2
(45) Date of Patent: Jul. 2, 2013

(54) METHOD AND APPARATUS FOR SECURING A CHILD

(75) Inventor: Peter V. Schwartz, San Luis Obispo, CA (US)

(73) Assignee: Peter V. Schwartz, San Luis Obispo, CA (US)

( * ) Notice: Subject to any disclaimer, the term of this patent is extended or adjusted under 35 U.S.C. 154(b) by 465 days.

(21) Appl. No.: 12/419,292

(22) Filed: Apr. 6, 2009

(65) Prior Publication Data

US 2010/0084445 A1 Apr. 8, 2010

Related U.S. Application Data

(60) Provisional application No. 61/042,464, filed on Apr. 4, 2008.

(51) Int. Cl.
*A47D 13/02* (2006.01)

(52) U.S. Cl.
USPC ..... 224/159

(58) Field of Classification Search
USPC ..... 224/159
See application file for complete search history.

(56) References Cited

U.S. PATENT DOCUMENTS

| | | | | |
|---|---|---|---|---|
| 3,968,910 | A | 7/1976 | Dye et al. | |
| 4,484,700 | A * | 11/1984 | Bush | 224/161 |
| 4,608,811 | A * | 9/1986 | Echeverri | 54/44.2 |
| 4,848,067 | A * | 7/1989 | Martinsen | 54/44.2 |
| 4,993,612 | A | 2/1991 | Quimby, Sr. et al. | |
| 5,029,434 | A * | 7/1991 | Erickson | 54/44.1 |
| 5,071,047 | A | 12/1991 | Cordisco | |
| 5,230,451 | A | 7/1993 | Onozawa | |
| D359,596 | S * | 6/1995 | Burns | D30/135 |
| 5,435,272 | A | 7/1995 | Epstein | |
| 5,437,402 | A | 8/1995 | Ring | |
| D383,256 | S | 9/1997 | Hampton | |
| D393,363 | S | 4/1998 | Kataoka | |
| 6,098,856 | A | 8/2000 | Reilly | |
| 6,241,136 | B1 * | 6/2001 | Harriss | 224/158 |
| 6,345,745 | B1 | 2/2002 | Harriss | |
| 6,651,594 | B1 | 11/2003 | Bagwell | |

* cited by examiner

*Primary Examiner* — Brian D Nash
(74) *Attorney, Agent, or Firm* — Quine Intellectual Property Law Group, P.C.; Stephen J. LeBlanc

(57) ABSTRACT

Methods and an apparatus allow a child to be securely carried on a adult's shoulder's while allowing the adult substantial freedom of movement and free use of hands and arms. An embodiment comprises two ankle cuffs, each securely holding one of the child's ankles and a torso strap connected thereto for securing the child's ankles to the torso of the wearer.

20 Claims, 7 Drawing Sheets

METHOD AND APPARATUS FOR SECURING A CHILD

CROSS REFERENCE TO RELATED APPLICATIONS

This application claims benefit of priority from provisional application 61/042,464 filed 4 Apr. 2008, entitle "Parent Saddle."

The above referenced documents and application and all documents referenced therein are incorporated in by reference for all purposes.

PRECAUTIONARY REQUEST TO FILE AN INTERNATIONAL APPLICATION AND DESIGNATION OF ALL STATES

Should this document be filed electronically or in paper according to any procedure indicating an international application, Applicant hereby requests the filing of an international application and designation of all states. Applicant affirms that Applicant is a United States citizen or entity with rights to file in the United States Receiving office. Should this application be filed in as a national application in the United States, this paragraph shall be disregarded.

COPYRIGHT NOTICE

Pursuant to 37 C.F.R. 1.71(e), applicant notes that a portion of this disclosure contains material that is subject to and for which is claimed copyright protection (such as, but not limited to, design drawings or user instructions, or any other aspects of this submission for which copyright protection is or may be available in any jurisdiction.). The copyright owner has no objection to the facsimile reproduction by anyone of the patent document or patent disclosure, as it appears in the Patent and Trademark Office patent file or records. All other rights are reserved, and all other reproduction, distribution, creation of derivative works based on the contents, public display, and public performance of the application or any part thereof are prohibited by applicable copyright law.

FIELD OF THE INVENTION

The present invention relates to securing a generally non-infant child to an adult during walking, running, standing or similar activities.

The present invention relates to a method and/or system and/or apparatus for securing a non-infant child or similarly sized person or similar for carrying on the shoulders. In specific embodiments, the invention involves a method and/or system and/or apparatus for construction of such a system using simple strap material. In further embodiments, the invention involves one or methods that may be implemented using a variety of other materials or fastening devices.

BACKGROUND OF THE INVENTION

The discussion of any work, publications, sales, or activity anywhere in this submission, including in any documents submitted with this application, shall not be taken as an admission that any such work constitutes prior art. The discussion of any activity, work, or publication herein is not an admission that such activity, work, or publication existed or was known in any particular jurisdiction.

In various contexts, it is sometimes desired for one person to ride on the back or shoulders of another person. A variety of devices exist to facilitate this practice. Most of them are similar to a backpack, securing the child onto the back of the adult, often with a rigid frame. However, many adults simply allow non-infant children to ride on their shoulders, unencumbered by any hardware.

Shoulder riding without use of a harness or support requires the adult to ensure that the child remains on the shoulders of the adult. This is typically done by the adult using one or both hands or arms to hold on to the child's legs or feet or ankles. This presents a safety as well as a convenience concern because the adult holding a child in this way is unable to use his or her hands either for grasping or balance without risk that the child will fall from his or her shoulders.

One previously proposed design, discussed in U.S. Pat. No. 5,437,402, uses ankle holders connected together and then attached with a vertical strap to the waist of the adult, with a suspender clip and/or key clip connected to the front of the wearer's belt, belt loop or trousers.

A different previously proposed designed, discussed in U.S. Pat. No. 6,098,856, uses ankle holders connected to underarm straps and a child seat and head strap to secure a child in a seat.

Another previously proposed designed, discussed in U.S. Pat. No. 4,993,612, provides stirrups and a child-waist strap to allow a child to more easily ride on an adults back.

Many other approaches for carrying or securing are discussed in the below listed references:

| | | | |
|---|---|---|---|
| 2,059,563 | Baby's sleeping harness | November, 1936 | Donoghue |
| 2,093,744 | Bed harness for children | September, 1937 | Tuckey |
| 3,698,608 | Shoulder saddle assembly | October, 1972 | Entwistle |
| 3,968,910 | Shoulder pack child carrier | July, 1976 | Dye et al. |
| 4,004,583 | Restraining device | January, 1977 | Johnson |
| 4,184,528 | Berry and fruit picking container | January, 1980 | Kobilan |
| 4,416,403 | Child carrying back pack | November, 1983 | Johnson |
| 4,422,455 | Restraining device | December, 1983 | Olsen |
| 4,484,700 | Device for use in carrying a child | November, 1984 | Bush |
| 4,608,811 | Toy saddle adapted to be carried by an adult person | Sep. 2, 1986 | Echeverri |
| 4,610,244 | Brace for restraining shoulder | September, 1986 | Hammond |
| 4,667,624 | Safety harness for children | May, 1987 | Smith |
| 4,728,553 | Prisoner leg restraint | March, 1988 | Daniels |
| 4,757,925 | Baby carrier | July, 1988 | Knittel |
| 4,892,208 | Child-resistant closure assembly | January, 1990 | Sledge |
| 4,901,898 | Waist-mounted infant carrier | Feb. 20, 1990 | Colombo |
| 4,986,458 | Infant carrier | January, 1991 | Linday |
| 4,986,599 | Baby carrier | January, 1991 | Wise |
| 4,993,612 | Portable back carrier for carrying a person | February, 1991 | Quimby, Sr. et al. |

-continued

| | | | |
|---|---|---|---|
| 5,011,057 | Baby carrier | April, 1991 | Perruzza et al. |
| 5,011,221 | Baby carrier | April, 1991 | Wise |
| 5,071,047 | Baby carrier | December, 1991 | Cordisco |
| 5,205,450 | Child carrier | April, 1993 | Derosier |
| 5,230,451 | Harness for neck-worn articles | July, 1993 | Onozawa |
| 5,244,292 | Baby carrier | September, 1993 | Wise |
| 5,256,119 | Leg extension exercise device | October, 1993 | Tudor |
| 5,263,618 | Universal carrier for articles | November, 1993 | Talavera |
| 5,361,952 | Baby carrier | November, 1994 | Gold |
| 5,435,272 | Support harness for a young child | Jul. 25, 1995 | Epstein |
| 5,437,402 | Child carrier | Aug. 1, 1995 | Ring |
| 5,454,498 | Baby carrier | October, 1995 | Dunn et al. |
| 5,490,620 | Child-supporting shoulder harness | February, 1996 | Bergqvist |
| 5,522,528 | Baby carrier apparatus | June, 1996 | Petricola |
| 5,570,823 | Baby carrier | November, 1996 | Lindy |
| 5,609,279 | Child carrier | March, 1997 | O'Shea |
| 5,632,425 | Infant carrier | May, 1997 | Hull |
| 5,690,258 | Baby carrier | November, 1997 | Kataoka |
| 5,730,490 | Handle supported cover for infant car seat carrier | March, 1998 | Mortenson |
| 5,732,861 | Baby carrying harness and clasp means therefor | March, 1998 | Jakobson |
| 5,772,088 | Adjustable infant carrier | June, 1998 | Nelson |
| 5,772,279 | Coupling system for infant carrier to second support device | June, 1998 | Johnson, Jr. |
| 5,791,535 | Soft infant carrier | August, 1998 | Roan et al. |
| 5,813,580 | Soft-sided infant carrier convertible to hip carrier | September, 1998 | Fair |
| 5,988,670 | Child carrier | November, 1999 | Song et al. |
| 6,070,890 | Infant carrier mounting system | June, 2000 | Haut et al. |
| 6,095,614 | Child carrier harness | August, 2000 | Canna et al. |
| 6,098,856 | Shoulder baby carrier | August, 2000 | Reilly |
| 6,098,857 | Backpack baby carrier | August, 2000 | Le Gal |
| 6,186,381 | Child carrier | February, 2001 | Kernkamp |
| 6,213,362 | Sling-type infant carrier | April, 2001 | Lorenzini et al. |
| 6,244,483 | Carrier device | June, 2001 | McLemore et al. |
| 6,247,755 | Child carrier harness | June, 2001 | Canna et al. |
| 6,318,608 | Child carrier | November, 2001 | Fowler et al. |
| 6,331,032 | Infant carrier mounting system | December, 2001 | Haut et al. |
| 6,363,558 | Infant support with an improved securement device | April, 2002 | Dunne |
| 6,491,195 | Carrier device | December, 2002 | McLemore et al. |
| 6,763,983 | Infant carrier | July, 2004 | Norman |

Foreign References:

| | | |
|---|---|---|
| WO/2000/064297 | November, 2000 | A NURSING BAG |
| WO/2001/005264 | January, 2001 | A BAG WITH TWO CONVEX LIDS |
| WO/2001/084984 | November, 2001 | A BABY CARRYING HARNESS |

SUMMARY

According to specific embodiments, the present invention is involved with methods and/or systems and/or devices and/or designs that can be used together or independently to provide a more secure and flexible method or apparatus for carrying a child on an adult's shoulders or for similar carrying situations.

The invention and various specific aspects and embodiments will be better understood with reference to the following drawings and detailed descriptions. For purposes of clarity, this discussion refers to devices, methods, and concepts in terms of specific examples. However, the invention and aspects thereof may have applications to a variety of types of apparatus and methods. It is therefore intended that the invention not be limited except as provided in the attached claims and equivalents.

Furthermore, it is well known in the art that a variety of pliable yet strong materials can be fashioned into straps and holders such as described herein and that many different types of fasteners can be used to make various attachments and adjustments to straps or cuffs as described herein. A number of such types of straps and fasteners are discussed in one or more of the above listed references. Different embodiments of the invention can include different mixtures of materials, fastening and adjusting mechanisms, elements and functions and may group various functions as parts of various elements. For purposes of clarity, the invention is described in terms of apparatus that include different innovative components and innovative combinations of innovative components and known components. No inference should be taken to limit the invention to combinations containing all of the innovative components listed in any illustrative embodiment in this specification.

In some of the drawings and detailed descriptions below, the present invention is described in terms of the important independent embodiment of a simple combination of straps made from nylon webbing or similar materials and clasps or fasteners made of plastic. This should not be taken to limit the invention, which, using the teachings provided herein, can be applied to other materials, such as cloth, ropes, denim, rubber, hemp, plastic etc. The invention can also be partly incorporated into a garment, footwear, or other item worn by an adult or child.

All references, publications, patents, and patent applications cited herein are hereby incorporated by reference in their entirety for all purposes.

DESCRIPTION OF SPECIFIC EMBODIMENTS

Before describing the present invention in detail, it is to be understood that this invention is not limited to particular apparatus, compositions, systems, or methods, which can, of course, vary. It is also to be understood that the terminology used herein is for the purpose of describing particular embodiments only, and is not intended to be limiting. As used in this specification and the appended claims, the singular forms "a", "an" and "the" include plural referents unless the content and context clearly dictates otherwise. Thus, for example, reference to "a device" includes a combination of two or more such devices, and the like.

Unless defined otherwise, terms used herein have meanings as commonly understood by one of ordinary skill in the art to which the invention pertains. Although any methods and materials similar or equivalent to those described herein can be used in practice or for testing of the present invention, the preferred materials and methods are described herein. The description of any particular method of construction or operation of the invention shall not be taken as limiting except as provided in the attached claims including all allowable equivalents.

1. Overview

Figure 1:
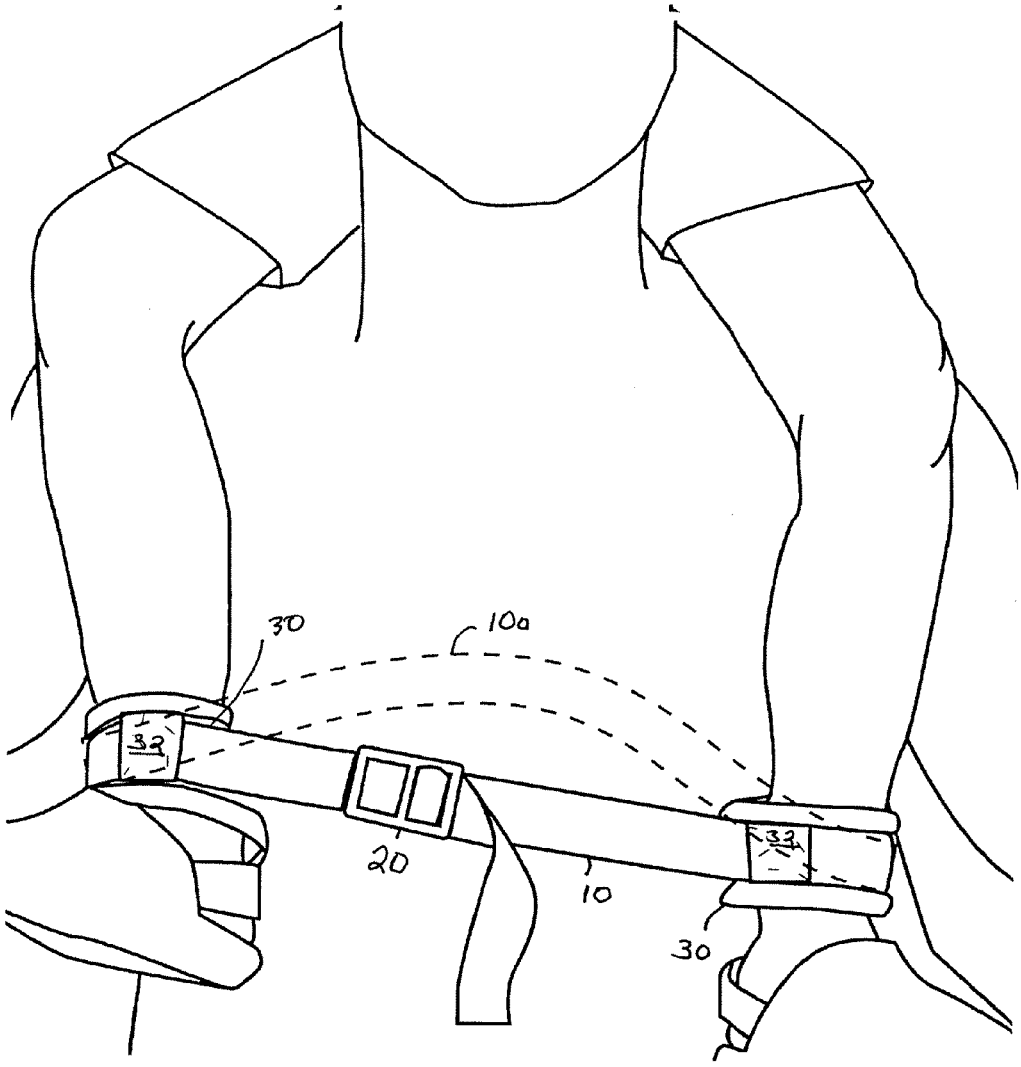
FIG. 1 is a diagram illustrating an adult carrying a child using a carrier harness according to specific embodiments of the present invention and shows a front view of an embodiment of the invention.

FIG. 1 is a diagram illustrating an adult carrying a child using a carrier harness according to specific embodiments of the present invention and shows a front view of an embodiment of the invention. In a presently preferred embodiment, the harness comprises an around-the-torso strap 10, an adjuster/fastener 20, and two ankle holders 30. In a presently preferred embodiment the around-the-torso strap is constructed of nylon fabric or nylon webbing fixed with a fastener 20, that allows the effective length of the strap to be adjusted, as would be commonly understood in the art. The around-the-torso strap is shown in the drawings as passing behind the adult's body, as shown by dashed lines 10*a*. The strap can be worn without a shirt or over or under a shirt. Padding can be placed or affixed to any or all parts of the strap that are in contact with the adult's body.

Ankle holders (or cuffs) 30 are positioned between the around-the-torso strap and the adult's torso. The are optionally provided with one or more external ankle holder loops 32 that the around toe torso strap can pass through, securing the ankle holders and optionally allowing for some horizontal placement adjustment of the cuffs along the torso strap.

In contrast to prior designs, a harness according to specific embodiments of the invention holds the child's feet snugly to the body of the adult, without pulling the feet sharply down as required in some prior art designs. Thus, the invention allows the child's ankles to be held securely while providing comfort to the child and a high degree of freedom of movement to the adult carrier. In experiments, it has been found that an adult carrier can run moderately fast and turn and move from side to side freely, using free hands and arms for balance, while the child remains secure without the child's groin or buttocks being pulled uncomfortably into the adults neck.

Furthermore, in contrast to some prior designs, a harness according to specific embodiments of the invention holds the child's feet snugly to the body of the adult independently of the tightness or failure of ankle holders 30. Because torso strap 10 is goes around the outside of the ankle holders, strap 10 secures both the holders and ankles to the adult's torso. The child's ankles remain secure even if there is slippage or failure of any fastener provided with the ankle cuffs. Also, because of this construction, an adult wearer is more immediately aware if there is any loosening of the ankle holders because they can feel the secured child's ankles against their body and will be immediately aware of slippage.

Around-the-Torso Strap

According to specific embodiments of the invention, a presently preferred position for the around-the-torso strap is around the pectoralis muscles. However, an around-the-torso strap according to specific embodiments of the invention could wrap around the adult's torso as high as immediately below the armpits and as low as at the bottom of the rib cage. The ideal position generally depends on the sizes of the adult and the child. In specific embodiments, the invention allows the around-the-torso strap to be positioned so that a child's ankles will be secured at the natural position at which the ankles would hang when the child is sitting on the adults shoulders.

The torso strap may close by a variety of fasteners according to specific embodiments of the invention. While fastener 20 in FIG. 1 generally illustrates a simple buckle, any buckle, snaps, strap, ties, Velcro, or other fastening mechanism known in various arts (such as the construction of luggage, backpacks, and other known apparatus using straps) can be used.

The comfort and security of the child can be improved by adding padded to ankle holders 30, which can be partially rigid padding material or foam or cotton-type padding. Ankle holders 30 further include fasteners, which may be buckles such as 34 shown in FIG. 2 or an attaching material such as Velcro placed on the outside surface 36 and inside surface 38 of the holders, as will be understood in the art. The ankle holders may be secured to the around-the-torso strap at a fixed position, or may slide along the around-the-torso strap for example using loops 32.

While a child can sit on the bare shoulders of an adult, comfort and security may be improved with the addition of a soft or rigid seat between the shoulders of the adult and the buttocks of the child. This saddle may attach to the around-the-torso strap and may be as simple as a piece of fabric, a pillow, or padding. Another embodiment is that of a rigid seat made of padded, rigid plastic.

Figure 2:
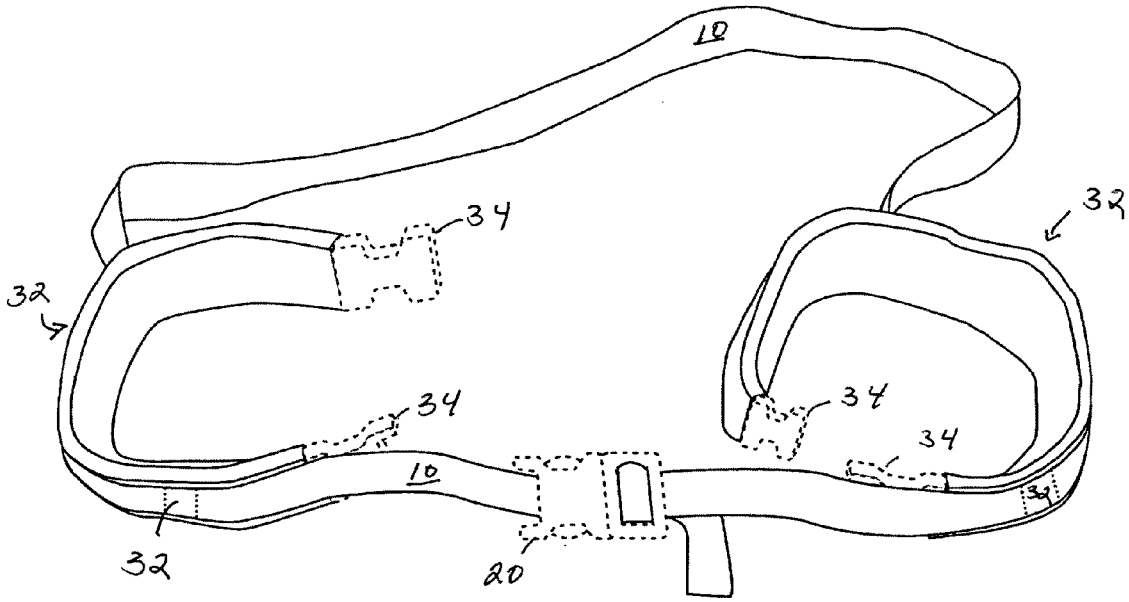
FIG. 2 is a diagram illustrating a carrier harness with an around-the-torso strap attached to two ankle holders according to specific embodiments of the present invention.

FIG. 2 is a diagram illustrating a carrier harness with an around-the-torso strap attached to two ankle holders according to specific embodiments of the present invention. The figure illustrates one very simple possible construction of a carrier of the invention. In this figure, ankle cuffs 30 are attached to strap 10 by attaching one or two strap-loops to the outside of the cuffs (which function similarly to pant belt loops) through which the strap passes. The straps can be made from any suitably strong and flexible material (such as denim, canvass, nylon, etc.) an can be adjustably secured around the child's ankle by any known securing structure, such as a buckle or Velcro. In this embodiment, the around-the-torso strap is secured with two-piece adjustable plastic buckles 20 that optionally can be slipped through the loops on the cuffs.

A prototype ParentSaddle™ has been constructed with simple straps as shown in the provisional patent application. However, this was somewhat painful for the child's ankles when the adult was moving somewhat vigorously. Therefore, in further embodiments, a padded ankle holder was added using either "surfboard" padding or modified "tennis elbow braces".

Figure 3:
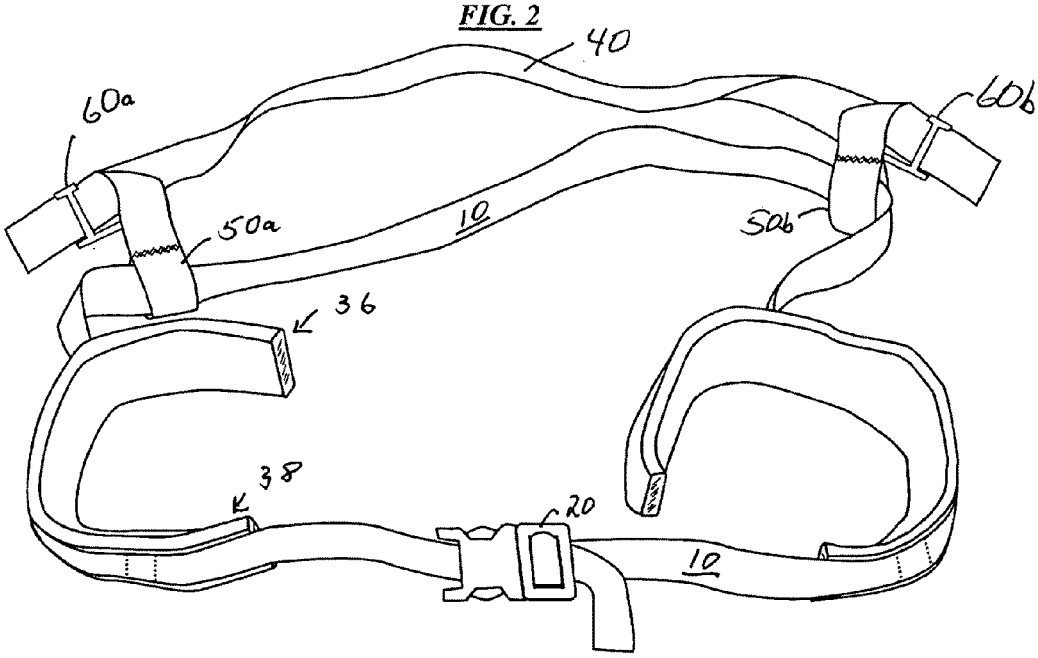
FIG. 3 is a diagram illustrating an alternative embodiment of a carrier harness with an around the torso strap attached to two ankle holders and a neck strap according to specific embodiments of the present invention.
Figure 4:
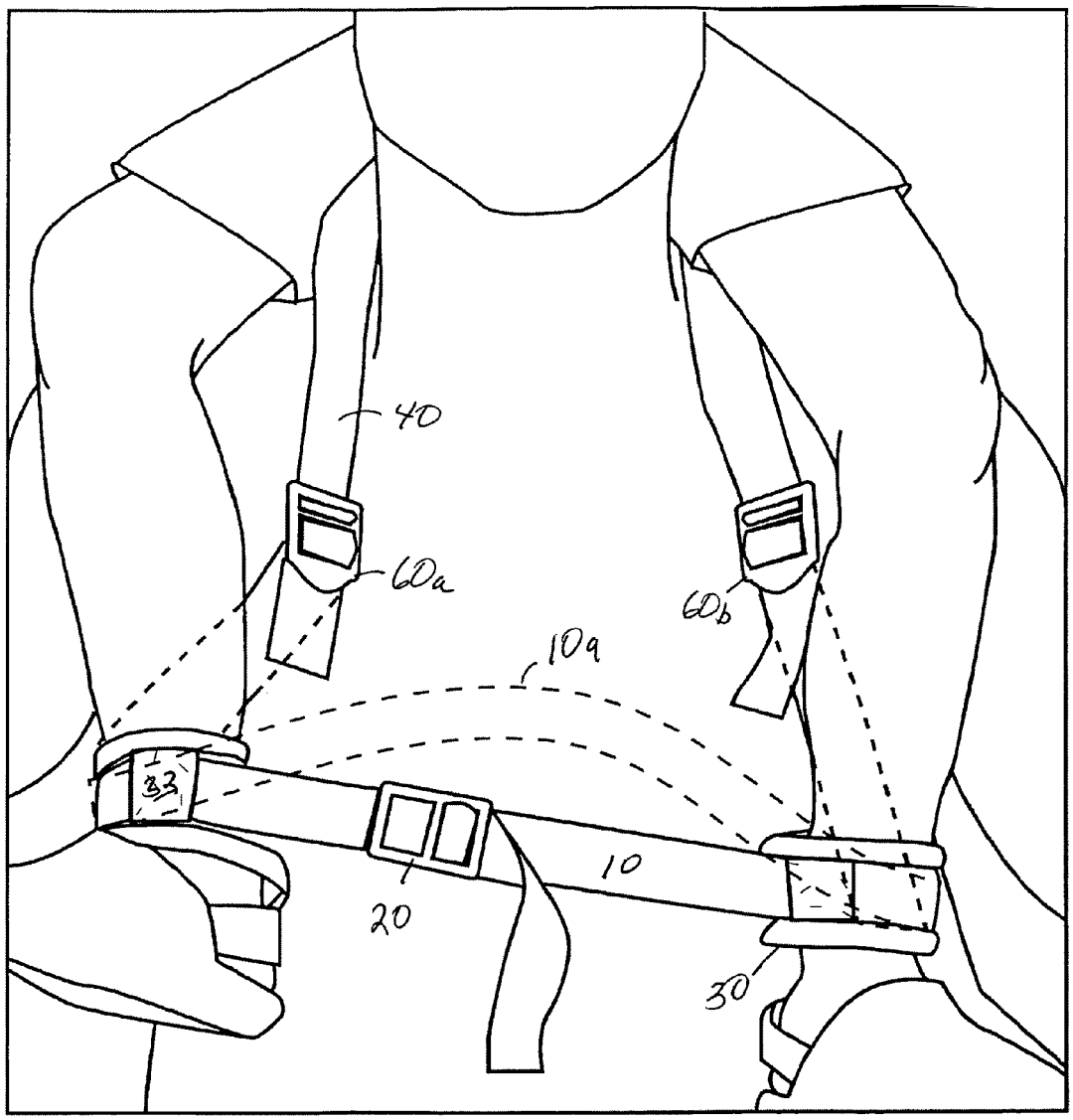
FIG. 4 is a diagram illustrating an adult wearing a carrier harness and carrying a child according to an alternative specific embodiment of the present invention.
Figure 5:
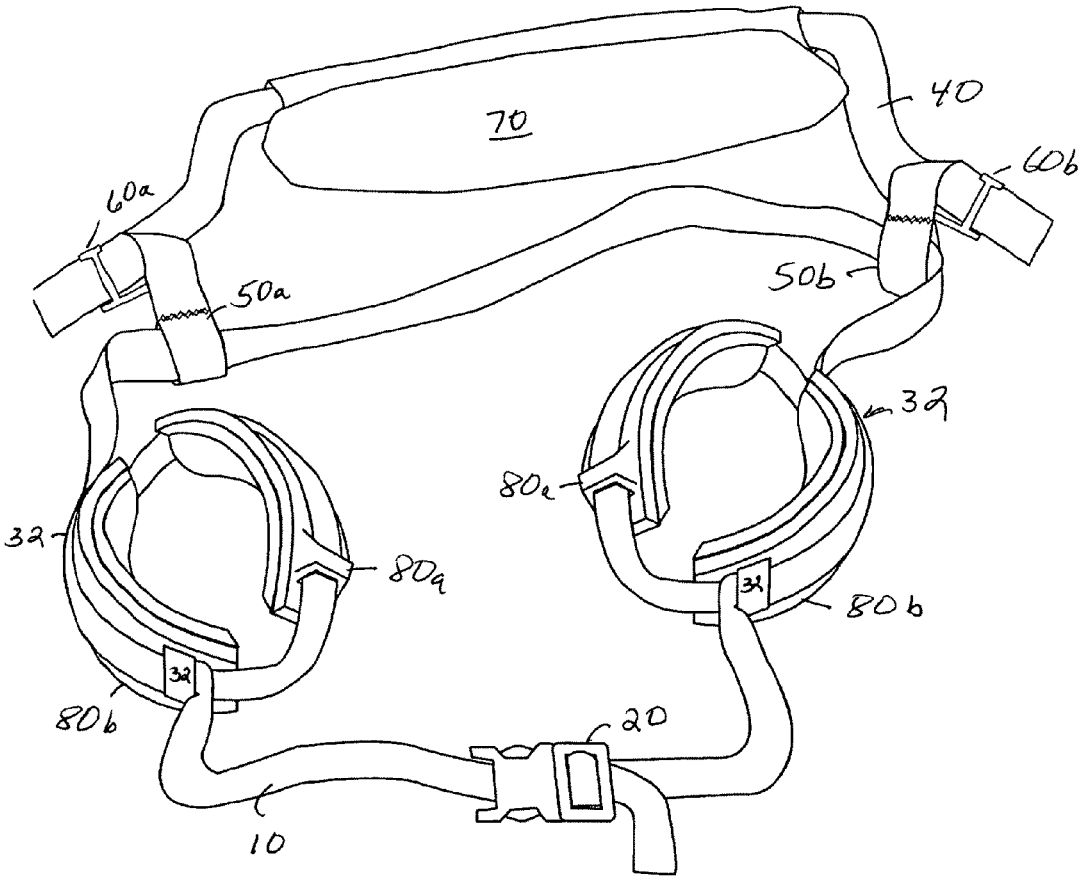
FIG. 5 is a diagram illustrating an alternative embodiment of a carrier harness with an around-the-torso strap attached to two ankle holders and an optional neck strap with a pillow according to specific embodiments of the present invention.

FIG. 3 is a diagram illustrating an alternative embodiment of a carrier harness with an around the torso strap attached to two ankle holders and a neck strap according to specific embodiments of the present invention. The around-the-neck strap secures the ParentSaddle™ in place if the child is removed, and can also secure a pillow under the buttocks of the child as shown in FIG. 5. This figure illustrates a presently preferred embodiment wherein a neck strap 40 is attached to two loops 50*a* and 50*b* and optionally provided with one or two length adjustment buckles 60*a* and 60*b* and with a neck padding 70. The adjustable over-the-neck strap holding the ParentSaddle™ in place if the child is removed is is advantageous if the child alternates between parent-riding and independent walking with high frequency, which is often the case. The pillow can be sewn directly to the around-the-neck strap or be connected using Velcro, a loop, or any other convenient mechanism. In specific implementations, padded ankle cuffs were made from denim and fabric and the around-the-torso strap was made from webbing with plastic connectors. FIG. 4 is a diagram illustrating an adult wearing a carrier harness and carrying a child according to an alternative specific embodiment of the present invention.

Optionally, one or more handles strap may be secured to the around-the-torso strap using the same general construction as the around the neck strap. These handles may be provided to allow the child to feel more secure.

Optionally, a seat-belt or a saddle may be secured to the around-the-torso strap using the same general construction as the around the neck strap. This may provide additional comfort for longer carrying times and additional safety for younger children.

FIG. 5 is a diagram illustrating an alternative embodiment of a carrier harness with an around-the-torso strap attached to two ankle holders and an optional neck strap with a pillow according to specific embodiments of the present invention. Also illustrated in the figure is an alternative construction for ankle cuffs using two pieces 80*a* and 80*b* of a more rigid material, such as modified Band-It® "Tennis-Elbow straps."

Figure 6:
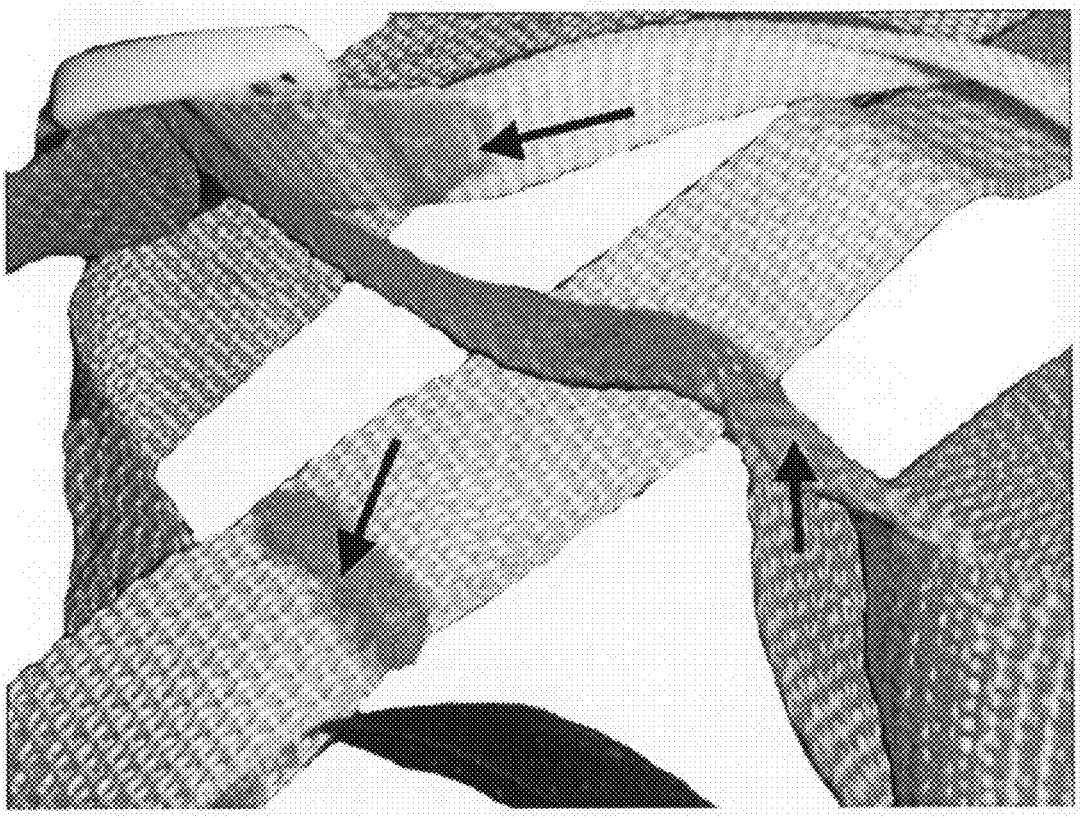
FIG. 6 is a diagram illustrating attaching nylon webbing in construction of a carrier according to specific embodiments of the present invention.

FIG. 6 is a diagram illustrating attaching nylon webbing in construction of a carrier according to specific embodiments of the present invention. In an example embodiment, webbing can be bonded by fuse-melting (indicated with arrows), whereby the melted (hot, often burning) edge or other part of webbing is firmly pressed against another piece of webbing. The construction is facilitated by of melt-fusion. Nylon and polypropylene webbing often fray at the ends. Typically, this is remedied by melting the ends which fuses the fibers. However, if the melted end is firmly pressed against another piece of webbing and allowed to cool, the two pieces are irreversibly bound. The process is simple, easy, and takes less than a minute, and typically takes less than 10 seconds. These bonds are indicated with arrows in the pictures below.

Example Methods

Figure 7:
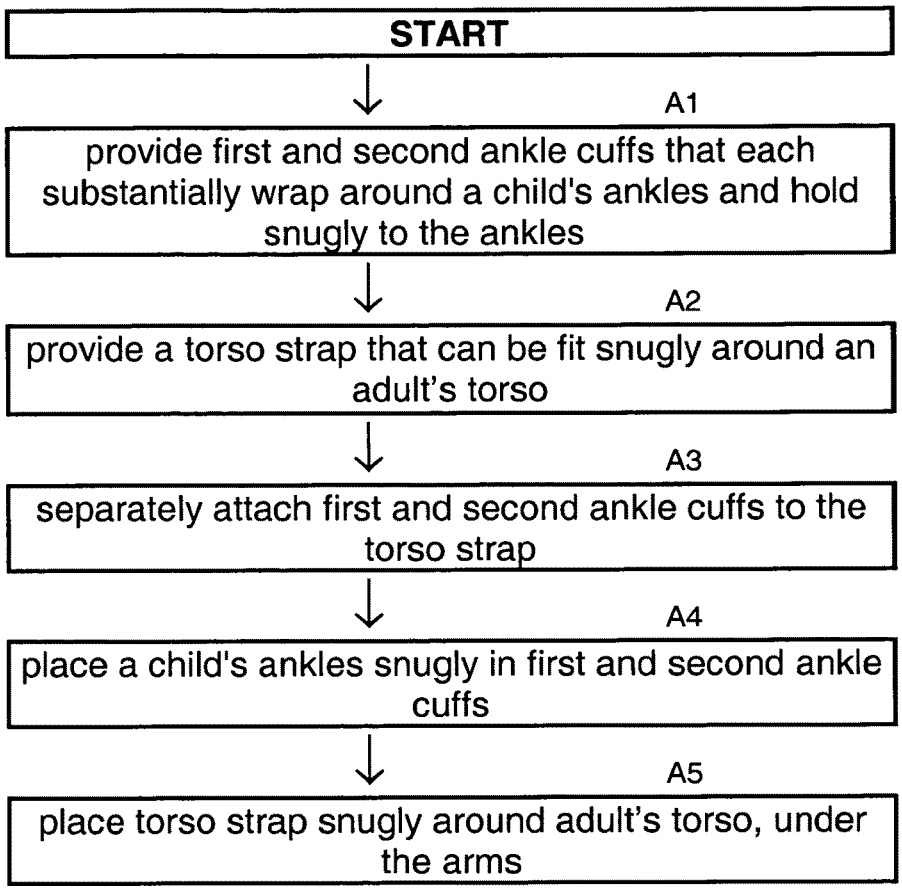
FIG. 7 is a flowchart illustrating a method of securing a child according to specific embodiments of the present invention.

FIG. 7 is a flowchart illustrating a method of securing a child according to specific embodiments of the present invention.

Figure 8:
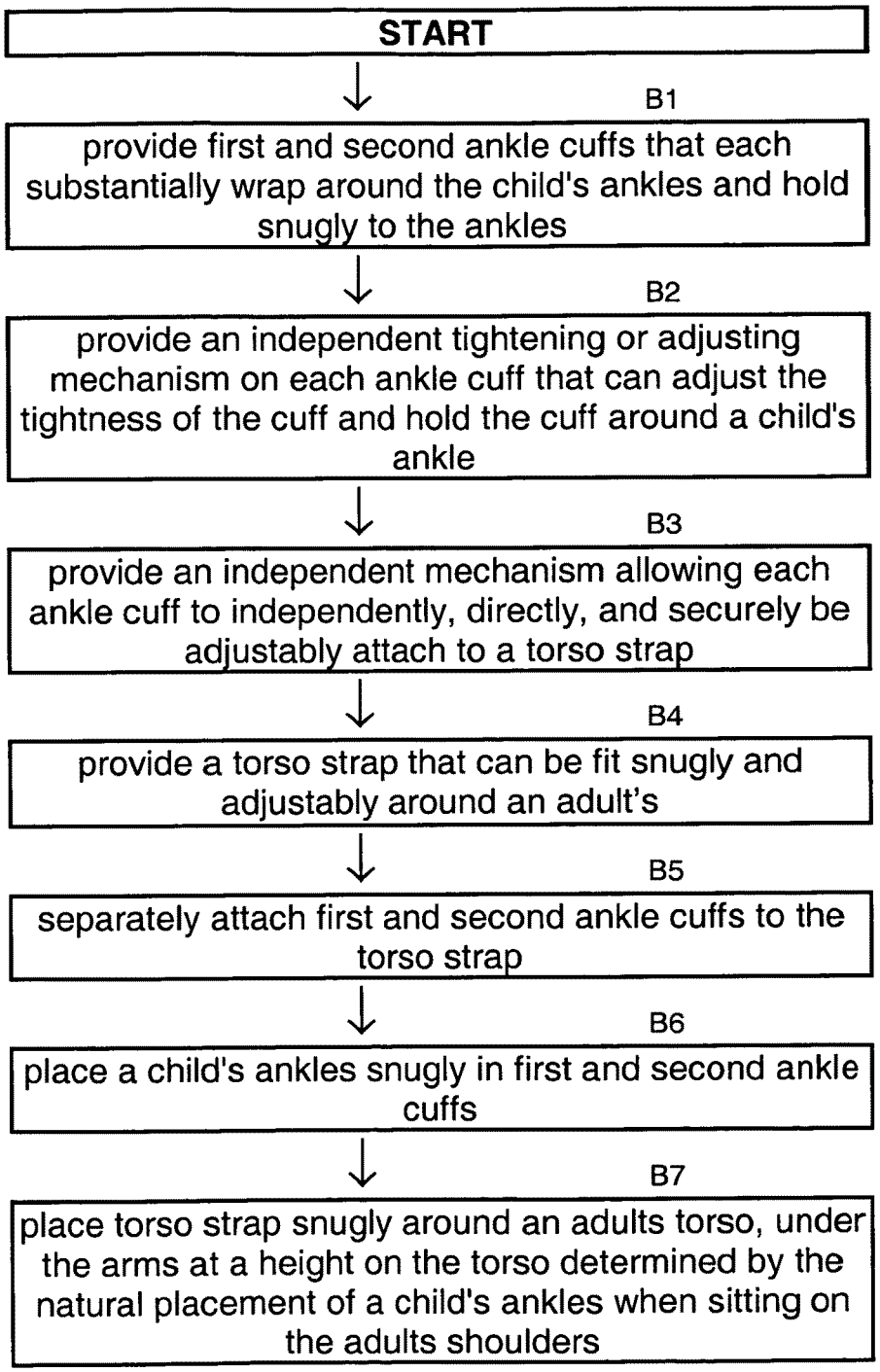
FIG. 8 is a flowchart illustrating a more detailed method of securing a child.

FIG. 8 is a flowchart illustrating a more detailed method of securing a child according to specific embodiments of the present invention.

All publications, patents, and patent applications cited herein or filed with this application, including any references filed as part of an Information Disclosure Statement, are incorporated by reference in their entirety.

What is claimed:

1. A method of securing a child on the shoulders of a person comprising the steps of:

securing the child's first ankle to a first ankle holder that snugly fits around the first ankle;

securing the child's second ankle to a second ankle holder that snugly fits around the second ankle;

securing an adjustable torso strap around said person, said adjustable torso strap wrapping around said person's chest and back to form a complete loop around said person's chest and back;

supporting a child on the shoulders of a person with the child's pelvis behind the person's head, the child's legs on opposite sides of the person's head with the child's knees in front of at least the middle of the person's head and the child's legs extending from behind the person's head to the front of the person's shoulders and down to the person's torso; and securing said first and second ankle holders directly to said adjustable torso strap such that the child's ankles are held against the torso of the person while the person is standing;

thereby securing the child by use of the shoulder strap and the first and second ankle holders only, with no other structure used to secure the child's ankles to the person's body.

2. The method according to claim 1 further wherein:

said torso strap is placed around the persons torso at a height determined by a natural placement of the child's ankles when the child is sitting on said person's shoulders.

3. The method of claim 1 wherein said steps of securing said ankles comprises:

securing said ankles with ankle cuffs.

4. The method of claim 3, wherein said ankle cuffs comprise a rigid fixture that only partially close around the child's limbs or full closures that may be rigid or flexible, which close by a variety of means including many forms of ties, buckles, and hook and loop fastener (such as VELCRO).

5. The method according to claim 1 further wherein:

said torso strap comprises an around-the-torso strap, said around-the-torso strap comprising a belt, strap, or some other garment or closure that secures to the body of said person.

6. The method according to claim 1 further comprising:
positioning said torso strap on said person between a position as high as immediately below said person's armpits and as low as a bottom of said person's rib cage.

7. The method according to claim 1 further comprising:
positioning said torso strap vertically on said person at a height determined by a desired placement of the child's ankles when the child is sitting on said person's shoulders;
positioning said ankle holders horizontally along said torso strap at a position determined by a desired placement of the child's ankles either near to or further out from the center of the adult's body.

8. The method according to claim 1 further comprising:
placing padding on one or more portions of said torso strap or said ankle holders.

9. The method according to claim 1 further comprising:
attaching one or more handle straps to said torso strap for said child to hold.

10. The method according to claim 1 further comprising:
placing a seatbelt around the waist of said child;
attaching said seatbelt to said torso strap.

11. An adult/child carrier harness comprising:
an adult torso strap that can be securely worn underneath the arms around an adult's chest and back forming a complete loop around said person's chest and back; and
two child ankle holders that can be securely fastened around a child's ankles and can be securely attached to said adult torso strap;
wherein said ankle holders fit snugly around a child's ankles so that a child cannot remove their ankles from the ankle holders by only moving their legs;
the carrier harness and the ankle holders configured such that when the strap is worn by an adult and the ankle holders are worn by a child and fastened to the strap, a child sitting on the adult's shoulders is secured from falling off while the adult is standing up even while running moderately fast or turning or moving from side to side and without requiring the adult to hold on to the child with the adult's hands thereby securing the child by use of the shoulder strap and the first and second ankle holders only, with no other structure used to secure the child's ankles to the person's body.

12. The harness of claim 11 further comprising:
an adjustable mechanism on said adult torso strap, said mechanism allowing said torso strap to be tightened.

13. The harness of claim 11 further comprising:
an adjustable fastener on said adult torso strap, said fastener allowing said torso strap to be opened and/or tightened.

14. The harness of claim 13 further wherein:
said adjustable fastener on said adult torso strap is a fastener selected from the group consisting of: a buckle, a clasp, a snap, a hook and loop fastener (such as VELCRO);
said adjustable fastener comprise a flexible or partially rigid or rigid fastener constructed of one or more flexible and or partially rigid materials, said one or more flexible or partially rigid materials selected from the group consisting of: metal, leather, plastic, polymers, ceramics, nylon, webbing, polyester, cloth, cotton, canvass, rope, hemp, natural or synthetic rubber, or any other material suitable for constructing an adjustable fastener as described herein.

15. The harness of claim 11 further comprising:
said adult torso strap is constructed of one or more flexible materials, said one or more flexible materials selected from the group consisting of: leather, plastic, polymers, nylon, webbing, polyester, cloth, cotton, canvass, rope, hemp, natural or synthetic rubber, or any other material suitable for constructing a torso strap as described herein;
said two child ankle holders comprise flexible around the ankle cuffs or partially rigid around the ankle cuffs, and are constructed of one or more flexible and or partially rigid materials, said one or more flexible or partially rigid materials selected from the group consisting of: metal, leather, plastic, polymers, ceramics, nylon, webbing, polyester, cloth, cotton, canvass, rope, hemp, natural or synthetic rubber, or any other material suitable for constructing around the ankle cuffs as described herein.

16. The harness of claim 11 further comprising:
an around-the-neck strap, said strap connecting to said adult torso strap, said strap not required for securing the child but used to hold the adult torso strap in place when a child is not secured by said harness;
said around-the-neck strap optionally comprising one or more adjustment mechanisms for adjusting the length of said around-the-neck strap.

17. An adult/child carrier harness comprising:
an openable and adjustable adult torso strap that can be securely worn underneath the arms around an adult's chest and back;
an adjustable fastener on said adult torso strap, said fastener allowing opening and tightening of said adult torso strap;
two child ankle cuffs, each cuff including an adjustable cuff fastener allowing said cuffs to be securely fastened around a child's ankles with at least an inside portion in contact with said child's ankles and an outside portion;
each cuff including one or more cuff loops on said outside portion of said cuff;
said cuff loops allowing through passage of said adult torso strap;
said cuff loops allowing said cuffs to be directly secured to said adult torso strap;
said cuff loops allowing said cuffs to be removed from said torso strap; and
said cuff loops allowing said cuffs to be adjustably positioned along said torso strap;
wherein said ankle cuffs are configured to be fitted snugly around a child's ankles so that a child cannot remove their ankles from the ankle holders by only moving their legs;
the carrier harness and the ankle holders configured such that when the strap is worn by an adult and the ankle holders are worn by a child and fastened to the strap by said loops, a child sitting on the adult's shoulders is secured from falling off by the ankle cuffs and the adult torso strap only with no other structure used to secure the child's ankles to the person's body, while the adult is standing up.

18. The harness of claim 17 further comprising:
an around-the-neck strap, said around-the-neck strap comprising:
two around-the-neck strap loops;
said around-the-neck strap loops allowing through passage of said adult torso strap;
said around-the-neck strap thereby holding said adult torso strap in place when a child is not secured by said harness said around-the-neck strap not necessary for securing the child;

said around-the-neck strap optionally comprising one or more adjustment mechanisms for adjusting the length of said around-the-neck strap;

said around-the-neck strap optionally comprising one or more padding or pillow portions for providing padding for comfort for said adult or child.

19. The harness of claim 17 further comprising:

said adult torso strap is constructed of one or more flexible materials, said one or more flexible materials selected from the group consisting of: leather, plastic, polymers, nylon, webbing, polyester, cloth, cotton, canvass, rope, hemp, natural or synthetic rubber, or any other material suitable for constructing a torso strap as described herein;

said two child ankle holders comprise flexible around the ankle cuffs or partially rigid around the ankle cuffs, and are constructed of one or more flexible and or partially rigid materials, said one or more flexible or partially rigid materials selected from the group consisting of: metal, leather, plastic, polymers, ceramics, nylon, webbing, polyester, cloth, cotton, canvass, rope, hemp, natural or synthetic rubber, or any other material suitable for constructing around the ankle cuffs as described herein.

20. The harness of claim 17 further wherein:

said adjustable fastener on said adult torso strap is a fastener selected from the group consisting of: a buckle, a clasp, a snap, a hook and loop fastener (such as VELCRO);

said adjustable fastener comprise a flexible or partially rigid or rigid fastener constructed of one or more flexible and or partially rigid materials, said one or more flexible or partially rigid materials selected from the group consisting of: metal, leather, plastic, polymers, ceramics, nylon, webbing, polyester, cloth, cotton, canvass, rope, hemp, natural or synthetic rubber, or any other material suitable for constructing around the ankle cuffs as described herein.

* * * * *

UNITED STATES PATENT AND TRADEMARK OFFICE

CERTIFICATE OF CORRECTION

PATENT NO. : 8,474,667 B2
APPLICATION NO. : 12/419292
DATED : July 2, 2013
INVENTOR(S) : Peter V. Schwartz It is certified that error appears in the above-identified patent and that said Letters Patent is hereby corrected as shown below:

In the Claims

Claim 1, Column 8, line 45 – "shoulder strap" should read "torso strap".

Claim 11, Column 9, line 41 – "shoulder strap" should read "torso strap".

Signed and Sealed this
Third Day of March, 2015

Michelle K. Lee

Michelle K. Lee
*Deputy Director of the United States Patent and Trademark Office*